US007630189B2

(12) United States Patent
Lalongé

(10) Patent No.: US 7,630,189 B2
(45) Date of Patent: Dec. 8, 2009

(54) HIGH VOLTAGE DISCONNECTING SWITCH CONTROL

(75) Inventor: Patrick Lalongé, McMasterville (CA)

(73) Assignee: Energie H.T. International Inc., Québec (CA)

( * ) Notice: Subject to any disclaimer, the term of this patent is extended or adjusted under 35 U.S.C. 154(b) by 435 days.

(21) Appl. No.: 11/798,815

(22) Filed: May 17, 2007

(65) Prior Publication Data

US 2008/0285194 A1 Nov. 20, 2008

(51) Int. Cl.
*H01H 47/00* (2006.01)

(52) U.S. Cl. ..... 361/160

(58) Field of Classification Search ..... 361/160
See application file for complete search history.

(56) References Cited

U.S. PATENT DOCUMENTS 2,181,080 A 11/1939 Elston
4,428,022 A 1/1984 Engel et al.
4,444,067 A 4/1984 Preuss et al.
4,567,565 A * 1/1986 Haselby et al. ..... 358/1.5
4,628,396 A 12/1986 Flemming
4,804,809 A 2/1989 Thompson, Jr. et al.
5,025,171 A 6/1991 Fanta et al.
5,031,493 A * 7/1991 Dorr ..... 83/13
5,034,584 A 7/1991 Fanta et al.
5,099,382 A 3/1992 Eppinger
5,254,814 A 10/1993 Harr
5,388,451 A 2/1995 Stendin et al.
5,834,909 A 11/1998 Marmonier
5,859,398 A 1/1999 McKean
6,362,445 B1 3/2002 Marchand et al.
6,466,420 B1 10/2002 Chuniaud et al.
6,531,841 B1 3/2003 Elli et al.
6,603,087 B2 8/2003 Österholm et al.
6,852,939 B2 2/2005 Rhein et al.
6,921,989 B2 7/2005 Baranowski et al.
6,930,271 B1 8/2005 Palmieri et al.

* cited by examiner

*Primary Examiner*—Stephen W Jackson
(74) *Attorney, Agent, or Firm*—Ogilvy Renault, LLP

(57) ABSTRACT

A system for controlling a high voltage switch having at least one connect/disconnect arm, the system comprising: actuating means for displacing the at least one connect/disconnect arm; an optical position sensor for determining a position of the at least one connect/disconnect arm; and a control module operatively connected to the actuating means and adapted to dynamically adjust a speed of motion of the at least one connect/disconnect arm as a function of the position of the at least one connect/disconnect arm.

26 Claims, 2 Drawing Sheets

HIGH VOLTAGE DISCONNECTING SWITCH CONTROL

CROSS-REFERENCE TO RELATED APPLICATIONS

This is the first application filed for the present invention.

TECHNICAL FIELD

The present invention relates to the field of switches that isolate a circuit or piece of electrical apparatus after interruption of the current, and more specifically, such switches for use with high voltage lines.

BACKGROUND OF THE INVENTION

A switch for disconnecting high voltage lines causes electric arcs which are created between the moving contact and the fixed contact. These arcs are harmful to the switch itself and to the connected equipment. Typically, many switches used on high voltage transmission lines are of the type which comprise a moving arm of a substantial length. It is difficult to move such an arm at a very high speed as damage to the switch would result.

Therefore, there is a need to reduce the electric arcs caused in existing systems, without completely replacing the structures presently in place.

SUMMARY OF THE INVENTION

In accordance with a first broad aspect of the present invention, there is provided a system for controlling a high voltage switch having at least one connect/disconnect arm, the system comprising: actuating means for displacing the at least one connect/disconnect arm; an optical position sensor for determining a position of the at least one connect/disconnect arm; and a control module operatively connected to the actuating means and adapted to dynamically adjust a speed of motion of the at least one connect/disconnect arm as a function of the position of the at least one connect/disconnect arm.

In accordance with a second broad aspect of the present invention, there is provided a method for controlling a high voltage switch having at least one connect/disconnect arm, the method comprising: optically sensing a position of the at least one connect/disconnect arm; dynamically adjusting a speed of motion of the at least one connect/disconnect arm as a function of the position of the at least one connect/disconnect arm; and actuating the at least one connect/disconnect arm in accordance with the speed of motion.

It should be understood that the term "switch" is to include any type of disconnector, disconnect switch, circuit breaker, or switch gear that serves to open and close a circuit at high voltage.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
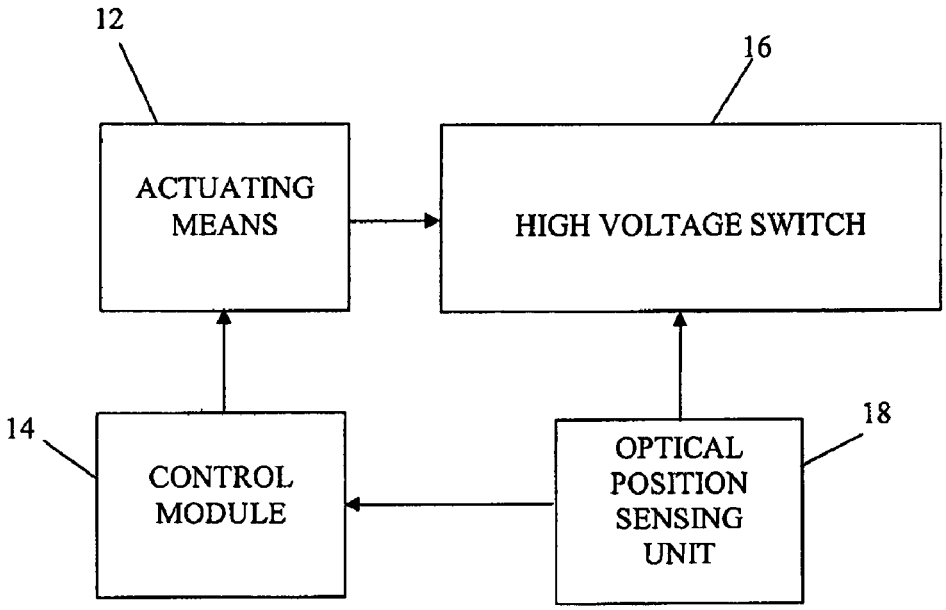
FIG. 1 is a block diagram illustrating an embodiment of the system of the present invention.

The system of FIG. 1 is for the real time control of at least one connect/disconnect switch 16 and for the operation and management thereof. The system may control many aspects of the operation including, but not limited to, environmental conditions (such as temperature and humidity levels), the motor for operating the switch, alarms, inputs and outputs, internal tests, and information management. In one embodiment, the system includes an on/off function as well as a function for programming the unit. External indicators may be used to indicate a status of the system, such as a position of the switch, whether opened or closed, and whether the system is active. External communication ports are also provided in order to retrieve data or programming information.

Actuating means 12 are provided to displace the connect/disconnect arm of the high voltage switch 16. The actuating means 12 may include a conventional motor having an output shaft and one or more gears mounted thereon. In one embodiment, the motor used by the system is an electric motor that operates at 2600 rotations per minute (RPM) to operate the switch arm. A gear system engages a gear mounted to drive the connect/disconnect arm. The person skilled in the art will understand that the motor and gear system described herein is merely one way of implementing the actuating means and that alternative ways will be readily understood.

A control module 14 is operatively connected to the actuating means 12. The control module 14 is adapted to dynamically adjust a speed of motion of the connect/disconnect arm as a function of the position of the connect/disconnect arm. The position of the connect/disconnect arm is determined by the optical position sensing unit 18, which then transmits this information to the control module 14. The control module 14 is set as a function of the type of equipment it is operating. For example, the settings for a switch having a single arm differ from the settings for a switch with two arms. In addition, the settings differ depending on the model of the equipment being operated.

The connect/disconnect arm is operated to have a plurality of speeds and the speed depends on the position of the arm, whether it is opening or closing, and the type of arm being operated. In accordance with an embodiment, when the switch is being opened, a first speed is set until the point when an arc forms between the moving contact and the fixed contact. At this moment, the arm is accelerated significantly until the arc breaks, after which the arm is decelerated until a fully open position. A brake is activated to stop the arm completely.

In accordance with another embodiment, when the switch is being closed, a high speed is immediately set and the arm moves quickly to reduce the duration of the arc being formed between the moving contact and the fixed contact of the switch. The speed is decreased when the arc is cut, which occurs when the moving contact comes into contact with the fixed contact. The arm is stopped when the fully closed position is reached. The speeds used to close the arm may differ from the speeds used to open the arm.

Figure 3:
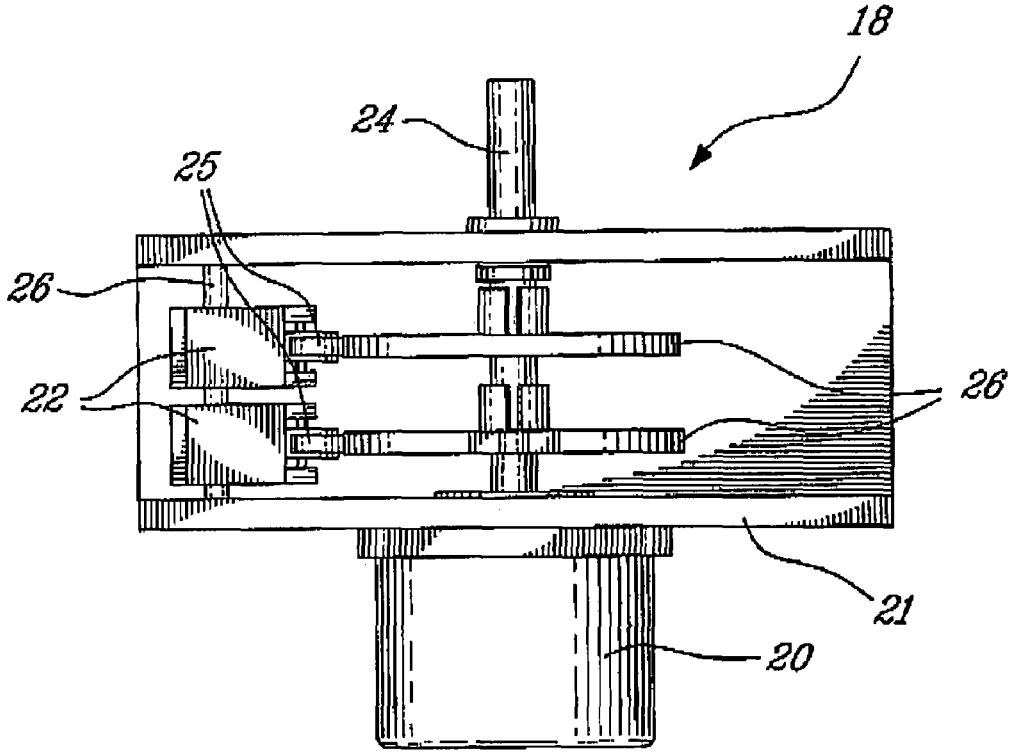
FIG. 3 is a top view of the optical position sensing unit of an embodiment of the present invention.
Figure 4:
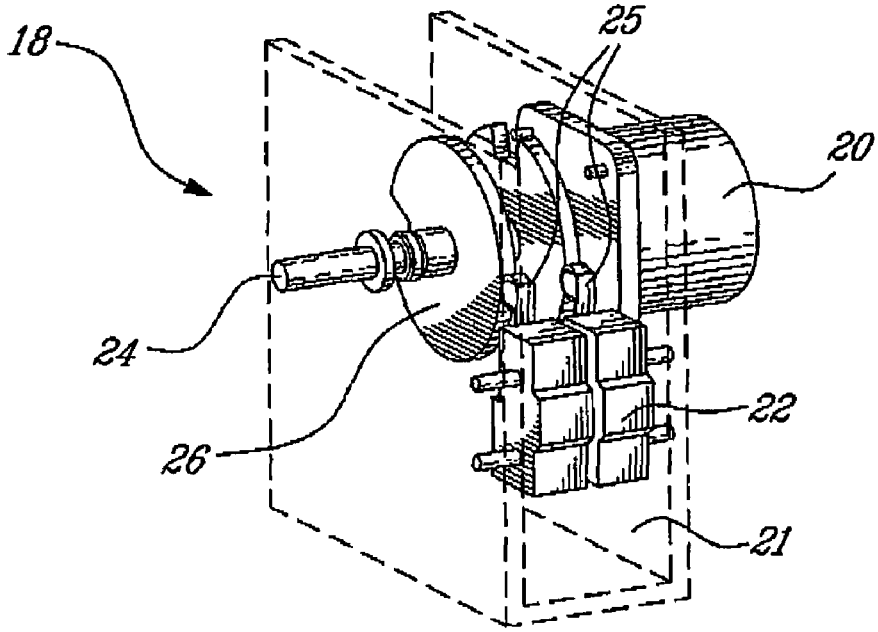
FIG. 4 is a side view of the embodiment shown in FIG. 3.

The optical position sensing unit 18 is further illustrated in FIGS. 3 and 4. FIG. 3 is a top view of the unit. The actual optical position sensor is seen at reference numeral 18. In accordance with an embodiment of the system, a redundant emergency system 21 is present in the unit as well. In the redundant emergency system 21, a pair of CAMs 26 are attached to a pair of micro-switches 22 to form two CAM switches. A pair of switch actuators 25 are present between the CAMs 26 and the micro-switches 22 and are used to actuate the switches 22. The CAMs 26 are mounted to a first shaft 24 and the micro-switches 22 are mounted to a second shaft 26 (or pair of, as shown in FIG. 4).

FIG. 4 illustrates how the optical position sensor 20 is mounted to the first shaft 24, which is connected to the connect/disconnect arm. Therefore, by recording the position of the shaft 24, the optical position sensor is essentially recording the position of the connect/disconnect arm. It should be understood that FIGS. 3 and 4 refer to an embodiment of the optical position sensing unit and that alternative embodiments using an optical position sensor will readily be understood by a person skilled in the art.

Figure 2:
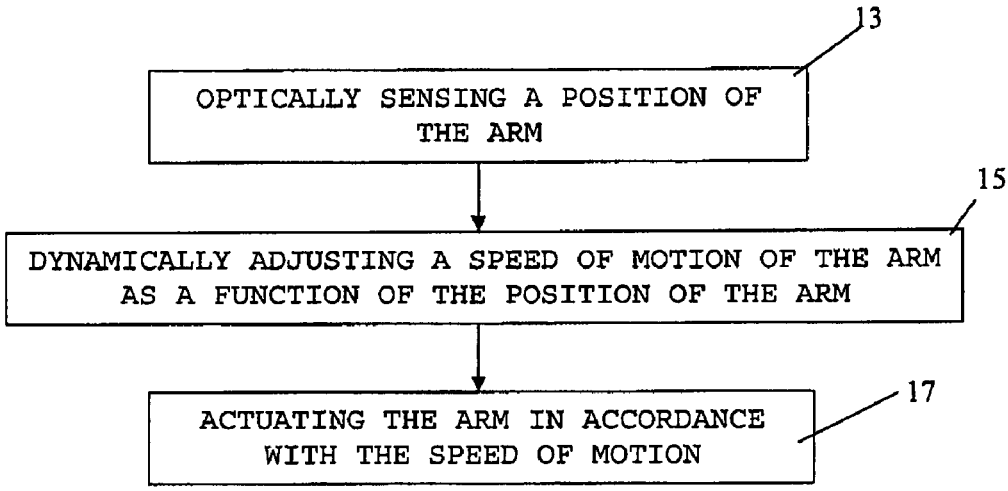
FIG. 2 is a flow chart illustrating a method of the present invention in accordance with an embodiment thereof.

FIG. 2 is a flow chart illustrating an embodiment of the method of the present invention. A first step consists in optically sensing the position of the arm 13. As a function of the sensed position, the speed of motion of the arm is dynamically adjusted 15, and the arm is actuated in accordance with the adjusted speed 17. The speed of the arm depends on the position of the arm in order to eliminate or reduce arcing in the switch.

When the arm is initially moved when opening the switch, its speed is relatively low to reduce damage to the switch. It's speed is accelerated when the position of the arm reaches a point where an arc would typically occur and decelerated when the arc is cut. In some instances, as few as two speeds are used to open and/or close the switch whereas in other instances, as many as seven different speeds are used to operate the arm. The arc between the fixed contact and the moving contact is responsible for harmonics that are sent into the system and damage the surrounding equipment. By increasing the speed of the arm during the time the arc is formed, the duration of the arc is reduced which also reduces the harmonics and thereby protects the surrounding equipment.

An embodiment of the present system allows it to be retrofitted to known systems. In this case, the mechanical part of an existing system remains while the electromechanical part is replaced. Digital logic may be used to program the control module and the system is designed to be operative in various types of meteorological conditions. The system may also be programmed to provide daily maintenance to the motor. The state of the motor may be verified and a heating current may be sent to the coils of the motor to eliminate or reduce humidity when the arm is not activated. This can be done without changing the position of the arm.

It should be understood that the embodiments of the system of the present invention can work with any type of equipment, whether it be motorized, pneumatic, or hydraulic. In addition, the system may be powered by alternating or direct current. It should also be understood that the embodiments of the system of the present invention may operate switches of various configurations, including but not limited to "center break" switches, "semi-pantograph" switches, and "vertical break" switches.

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment. The embodiments of the invention described above are intended to be exemplary only. The scope of the invention is therefore intended to be limited solely by the scope of the appended claims.

I claim:

1. A system for controlling a high voltage switch having at least one connect/disconnect arm, the system comprising:

actuating means for displacing said at least one connect/disconnect arm;

an optical position sensor for determining a position of said at least one connect/disconnect arm; and a control module operatively connected to the actuating means and adapted to dynamically adjust a speed of motion of said at least one connect/disconnect arm as a function of said position of said at least one connect/disconnect arm.

2. A system as claimed in claim 1, wherein said control module comprises at least three speeds to which said at least one connect/disconnect arm can be set.

3. A system as claimed in claim 1, wherein said control module comprises digital logic.

4. A system as claimed in claim 1, further comprising at least one additional sensor connected to said control module for sensing at least one operating parameter of said system.

5. A system as claimed in claim 4, wherein said at least one additional sensor is a sensor for sensing environmental conditions of said system.

6. A system as claimed in claim 5, wherein said control module is adapted to determine a temperature and humidity level of said system in order to react to climate changes therein.

7. A system as claimed in claim 1, further comprising at least one external communication port.

8. A system as claimed in claim 7, wherein data obtained by said system can be retrieved via said at least one external port.

9. A system as claimed in claim 1, further comprising external indicators showing a status of said system.

10. A system as claimed in claim 9, wherein said external indicators show a position of said connecting/disconnecting arm.

11. A system as claimed in claim 1, wherein said actuating means comprise a motor having at least one speed of operation for opening and for closing said at least one connect/disconnect arm.

12. A system as claimed in claim 1, wherein when opening said at least one connect/disconnect arm, said control module adjusts said at least one connect/disconnect arm to a first speed until it reaches a point where an arc would commence, a second speed greater than said first speed until said arc is cut, and a third speed less than said second speed until a fully opened position is reached and a brake is activated, thereby bringing said at least one connect/disconnect arm to a stop.

13. A system as claimed in claim 1, wherein when closing said at least one connect/disconnect arm, said control module adjusts said at least one connect/disconnect arm to a first speed until after a formed arc has been cut and a second speed until a fully closed position is reached and a brake is activated, thereby bringing said at least one connect/disconnect arm to a stop.

14. A system as claimed in claim 1, wherein said control module is configured to adjust the speed of motion of said at least one connect/disconnect arm as a function of a type of equipment of said arm, and provides different speeds for initial movement of the arm, after an arc has been cut, and slow down of the arm.

15. A method for controlling a high voltage switch having at least one connect/disconnect arm, the method comprising:

optically sensing a position of said connect/disconnect arm;

dynamically adjusting a speed of motion of said at least one connect/disconnect arm as a function of said position of said at least one connect/disconnect arm; and actuating said at least one connect/disconnect arm in accordance with said speed of motion.

16. A method as claimed in claim 15, wherein said dynamically adjusting a speed of motion comprises adjusting said at least one connect/disconnect arm to at least three speeds.

17. A method as claimed in claim 15, further comprising sensing at least one additional operating parameter of said system.

18. A method as claimed in claim 17, wherein said at least one additional parameter is an environmental condition of said system.

19. A method as claimed in claim 18, further comprising determining a temperature and humidity level of said system in order to react to climate changes therein.

20. A method as claimed in claim 15, further comprising providing at least one external communication port on said system.

21. A method as claimed in claim 20, further comprising retrieving data obtained by said system via said at least one external port.

22. A method as claimed in claim 15, further comprising providing external indicators showing a status of said system.

23. A method as claimed in claim 22, wherein said external indicators show a position of said connecting/disconnecting arm.

24. A method as claimed in claim 15, wherein said actuating said at least one connect/disconnect arm comprises operating said at least one connect/disconnect arm at a first speed until it reaches a point where an arc would commence, a second speed greater than said first speed until said arc is cut, and a third speed less than said second speed until a fully opened position is reached and a brake is activated, thereby bringing said at least one connect/disconnect arm to a stop.

25. A method as claimed in claim 15, wherein said actuating said at least one connect/disconnect arm comprises operating said at least one connect/disconnect arm at a first speed until after a formed arc has been cut and a second speed until a fully closed position is reached and a brake is activated, thereby bringing said at least one connect/disconnect arm to a stop.

26. A method as claimed in claim 15, wherein said actuating said at least one connect/disconnect arm comprises adjusting the speed of motion of said at least one connect/disconnect arm as a function of a type of equipment of said arm, and providing different speeds for initial movement of the arm, after an arc has been cut, and slow down of the arm.

* * * * *